United States Patent [19]

Iizuka et al.

[11] 4,313,406

[45] Feb. 2, 1982

[54] MULTI-CYLINDER INTERNAL COMBUSTION ENGINE

[75] Inventors: Haruhiko Iizuka, Yokosuka; Fukashi Sugasawa, Yokohama, both of Japan

[73] Assignee: Nissan Motor Company, Limited, Yokohama, Japan

[21] Appl. No.: 94,887

[22] Filed: Nov. 16, 1979

[30] Foreign Application Priority Data

Nov. 17, 1978 [JP] Japan ..... 53-141175

[51] Int. Cl.[3] ..... F02D 17/02

[52] U.S. Cl. ..... 123/198 F; 123/568

[58] Field of Search ..... 123/198 F, 198 DB, 568

[56] References Cited

U.S. PATENT DOCUMENTS

| | | | |
|---|---|---|---|
| 2,250,814 | 7/1941 | Rohlin . | |
| 4,064,844 | 12/1977 | Matsumoto et al. . | |
| 4,064,861 | 12/1977 | Schulz | 123/198 F |
| 4,069,803 | 1/1978 | Cataldo | 123/198 F |
| 4,129,109 | 12/1978 | Matsumoto | 123/198 F |
| 4,186,715 | 2/1980 | Iizuka et al. | 123/198 F |
| 4,192,278 | 3/1980 | Iizuka et al. | 123/198 F |
| 4,231,338 | 11/1980 | Sugasawa et al. | 123/198 F |
| 4,242,997 | 1/1981 | Kohama et al. | 123/568 |
| 4,249,374 | 2/1981 | Sugasawa et al. | 123/198 F |

FOREIGN PATENT DOCUMENTS

| | | |
|---|---|---|
| 2737613 | 3/1978 | Fed. Rep. of Germany . |
| 2351274 | 12/1977 | France . |

*Primary Examiner*—P. S. Lall

*Attorney, Agent, or Firm*—Schwartz, Jeffery, Schwaab, Mack, Blumenthal & Koch

[57] ABSTRACT

An internal combustion engine is disclosed which includes a plurality of cylinders split into first and second groups, and an intake passage provided with a throttle valve and bifurcated downstream of the throttle valve into two branches, one communicated with the first group of cylinders and the other communicated through a stop valve with the second group of cylinders. The second group of cylinders are bypassed by an EGR passage provided therein with an EGR valve. Control means is provided for causing the air valve to open a predetermined time after the EGR valve closes when the engine operation is shifted from its low load condition to a high load condition.

5 Claims, 5 Drawing Figures

MULTI-CYLINDER INTERNAL COMBUSTION ENGINE

BACKGROUND OF THE INVENTION

1. Field of the Invention

This invention relates to a multi-cylinder internal combustion engine and, more particularly, to a split type internal combustion engine including a plurality of cylinders split into two groups and operable in a split-cylinder mode where one group of cylinders are held operative while the other group of cylinders are held suspended under engine low load conditions.

2. Description of the Prior Art

FIG. 1 is a schematic view of a conventional split type internal combustion engine. The engine comprises an engine body 1 containing therein a plurality of cylinders split into first and second groups, an intake passage 2 provided therein with a throttle valve 3 and divided downstream of the throttle valve 3 into first and second branches 2*a* and 2*b*, and an exhaust passage 4 provided with a three-way catalyzer (not shown) for purifying exhaust emissions. The first branch 2*a* communicates with the first group of cylinders #1 to #3 and the second branch 2*b* communicates through a stop valve 5 with the second group of cylinders #4 to #6. The second group of cylinders #4 to #6 are bypassed an exhaust gas recirculation (EGR) passage 6 provided therein with an EGR valve 7.

Under high load conditions, the stop valve 5 is open to allow fresh air to flow into the second group of cylinders #4 to #6 and the EGR valve 7 is closed to preclude re-introduction of exhaust gases into the second group of cylinders #4 to #6 so that the engine can operate in a full-cylinder mode where all of the cylinders are supplied with fuel and fresh air. When the engine is under low load conditions, the stop valve 5 is closed to block the flow of fresh air into the second group of cylinders #4 to #6 so that the engine can operate in a split-cylinder mode where the second group of cylinders are supplied with neither fuel nor fresh air. Under low load conditions, the EGR valve 7 is open to allow re-introduction of a portion of exhaust gases into the second group of cylinders so as to suppress pumping loss therein. Since the re-introduced exhaust gases are discharged from the suspended cylinders #4 to #6 during the split-cylinder mode of operation of the engine, the three-way catalyzer is held at a high temperature conductive to its maximum performance.

One difficulty with such a split-type internal combustion engine is that when the engine is shifted from a split-cylinder mode to a full-cylinder mode, the exhaust gases, which are re-introduced and filled in the second branch 2*b* of the intake passage 2 during the split-cylinder mode of operation, are drawn through the stop valve 5 into the first branch 2*a* since the second branch 2*b* is held substantially at atmospheric pressure due to recirculation of exhaust gases in amounts sufficient to suppress pumping loss in the suspended cylinders. This would cause miss fire in the first group of cylinders #1 to #3. However, any attempt to reduce the amount of exhaust gases recirculated into the second branch 2*b* so as to equalize the vacuum levels in the first and second branches 2*a* and 2*b* will cause an increased pumping loss and thus a fuel economy penalty. Furthermore, the filled exhaust gases are drawn into the second group of cylinders #4 to #6 to cause temporarily miss fire and rapid engine torque reduction just after the engine is shifted from a split-cylinder mode to a full-cylinder mode. This results in poor driving feel with shock and engine stalling if the engine is at low speeds.

SUMMARY OF THE INVENTION

It is therefore one object of the present invention to eliminate the above described disadvantages found in conventional split-type internal combustion engines.

Another object of the present invention is to provide an improved split type internal combustion engine which provides smooth running over the whole range of engine load conditions.

According to the present invention, these and other objects are accomplished by an internal combustion engine comprising a plurality of cylinders split into first and second groups, an intake passage provided therein with a throttle valve and divided downstream of the throttle valve into first and second branches, the first branch communicating with the first group of cylinders, the second branch communicating through a stop valve with the second group of cylinders, an EGR passage bypassing the second group of cylinders and provided therein with an EGR valve, fuel supply means for supplying fuel into the cylinders, a fuel injection control unit for providing, in synchronism with rotation of the engine, a drive pulse signal having its pulse width varying as a function of intake air flow to control the operation of the fuel supply means, detector means responsive to the drive pulse signal from the fuel injection control unit for providing a first signal under low load conditions and a second signal under high load conditions, means responsive to the first signal from the detector means for shutting off the supply of fuel into the second group of cylinders, first valve actuating means responsive to the first signal for causing the stop valve to close so as to shut off the flow of fresh air into the second group of cylinders and responsive to the second signal for causing the stop valve to open so as to allow fresh air to flow into the second group of cylinders, second valve actuating means responsive to the first signal for causing the EGR valve to open so as to allow exhaust gases to flow into the second branch and responsive to the second signal for causing the EGR valve to close so as to prevent recirculation of exhaust gases into the second branch, and delay means for delaying the operation of the stop valve with respect to the operation of the EGR valve.

Other objects, means, and advantages of the present invention will become apparent to one skilled in the art thereof from the following description.

DESCRIPTION OF THE PREFERRED EMBODIMENTS

Figure 1:
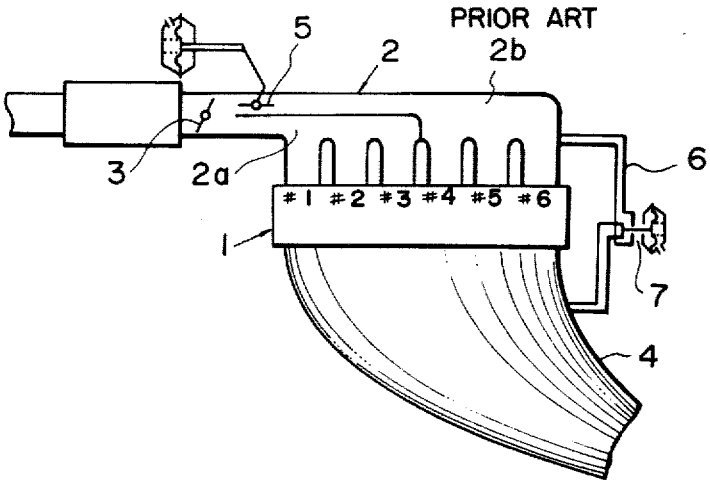
FIG. 1 PRIOR ART
FIG. 1 is a schematic sectional view showing a conventional split type internal combustion engine.
Figure 2:
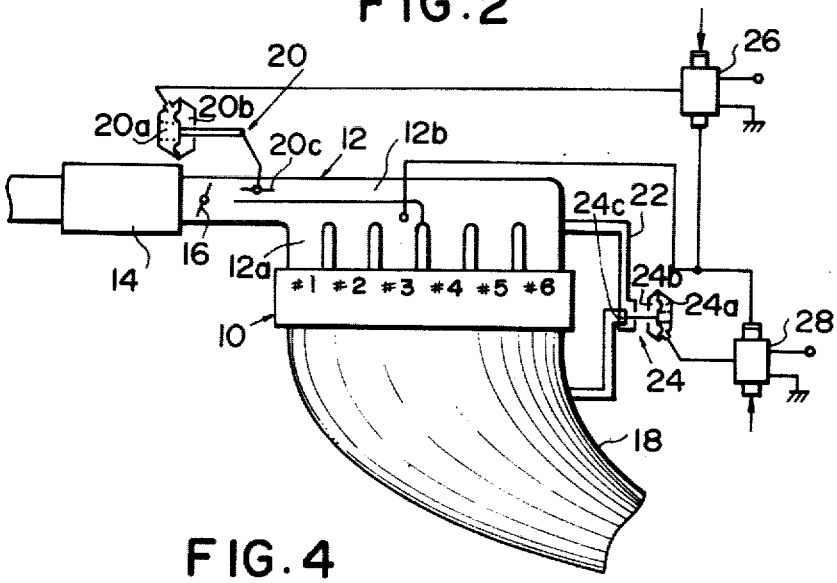
FIG. 2 is a schematic sectional view showing one embodiment of a split type internal combustion engine made in accordance with the present invention.

Referring now to FIG. 2, there is illustrated one embodiment of a split type internal combustion engine which comprises an engine body 10 containing a plurality of cylinders (in the illustrated case 6 cylinders) split into first and second groups, an intake passage 12 provided therein with an intake airflow sensor 14 and a throttle valve 16, and an exhaust passage 18. The intake passage 12 is divided downstream of the throttle valve 16 into first and second branches 12*a* and 12*b*, the first branch 12*a* communicating with the first group of cylinders #1 to #3 and the second branch 12*b* communicating through a stop valve assembly 20 with the second group of cylinders #4 to #6. The second group of cylinders #4 to #6 are bypassed by an EGR passage 22 having its one end openin into the exhaust passage 18 and the other end opening into the second branch 12*b*. The EGR passage 18 is provided therein with an EGR valve assembly 24.

The stop valve assembly 20 may be in the form of a vacuum operated unti which includes a diaphragm spreaded within a casing to divide it into vacuum and atmospheric chambers 20*a* and 20*b*, means drivingly connecting the diaphragm to a valve member 20*c* provided in the second branch 12*b*, and a balance spring provided within the vacuum chamber 20*a* for urging the diaphragm toward the atmospheric chamber 20*b* to cause the valve member 20*c* to open the second branch 12*b*. A first three-way solenoid valve 26 is provided which communicates the vacuum chamber 20*a* with the first branch 12*a* so as to cause the stop valve member 20*c* to close the second branch 12*b* when energized and with atmospheric air so as to cause the stop valve member 20*c* to open when deenergized.

Similarly, the EGR valve assembly 24 may be of a vacuum operated type which includes a diaphragm spreaded within a casing to divide it into vacuum an atmospheric chambers 24*a* and 24*b*, means drivingly connecting the diaphragm to a valve member 24*c* provided in the EGR passage 22, and a balance spring provided within the vacuum chamber 24*a* for urgin the diaphragm toward the atmospheric chamber 24*b* to cause the EGR valve to close the EGR passage 22. A second three-way solenoid valve 28 is provided which communicates the vacuum chamber 24*a* with atmospheric air so as to cause the EGR valve member 24*c* to open when energized and with the first branch 12*a* so as to cause the EGR valve member 24*c* to close when deenergized.

Figure 3:
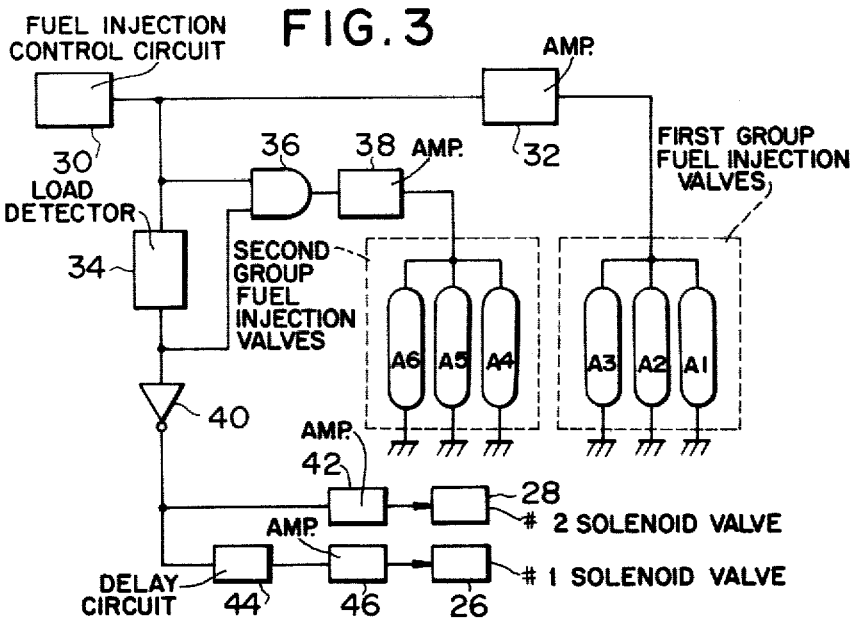
FIG. 3 is a block diagram of a control system for controlling the operation of the engine of FIG. 2.

Referring to FIG. 3, there is illustrated a control system for controlling the operation of the engine of FIG. 2. In FIG. 3, the letters A1 to A6 designated solenoid fuel injection valves for the respective cylinders #1 to #6. The fuel injection valves A1 to A3 are commonly connected to form a first group and the fuel injection valves A4 to A6 are commonly connected to form a second group.

Figure 4:
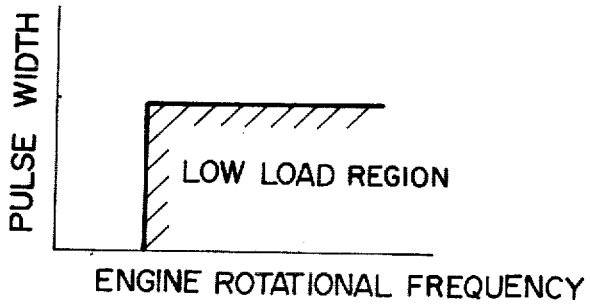
FIG. 4 is a diagram showing an area indicating low engine load conditions.

The control system comprises an electronic fuel injection control circuit 30 of the conventional type responsive to various engine operating factors such as engine rotational speed, intake air flow rate, etc. for providing, in synchronism with rotation of the engine, a drive pulse signal of pulse width varying in accordance with such engine operating factors so as to control the amount of fuel injected through the fuel injection valves. The drive pulse signal is applied to an amplifier 32 which, in turn, applies the signal, in an amplified condition, to the first group of fuel injection valves A1 to A3 for the first group of cylinders #1 to #3, respectively. The drive pulse signal is also applied to a detector circuit 34 which detects low load conditions, as indicated by the hatched area in FIG. 4, from the pulse width, duration and frequency of the drive pulse signal from the fuel injection control circuit 30. The detector circuit 34 provides a high output when the engine is under high load conditions and a low output when the engine is under low load conditions. The output of the detector circuit 34 is coupled to one input of an AND gate 36, the other input of which is coupled to the output of the fuel injection control circuit 30. The AND gate 36 passes the drive signal from the fuel injection control circuit 30 when the output of the detector circuit 34 is high and blocks it when the output of the detector circuit 34 is low. The output of the AND gate 36 is connected through an amplifier 38 to the second group of fuel injection valves A4 to A6 for the second group of cylinders #4 to #6, respectively. Thus, the drive pulse signal from the fuel injection control circuit 30 is applied to the second group of fuel injection valves A4 to A6 only when the output of the detector circuit 34 is high; that is, the engine is under high load conditions.

The output of th detector circuit 34 is also coupled to the input of an inverter 40. The output of the inverter 40 is coupled through an amplifier 42 to the second three-way solenoid valve 28 and also to a delay circuit 44 which, in turn, is connected through an amplifier 46 to the first three-way solenoid valve 26.

In operation, when the engine is under high load conditions, the detector circuit 34 provides a high output to allow the AND gate 36 to pass the drive pulse signal from the fuel injection control circuit 30 through the amplifier 38 to the second group of fuel injection valves A4 to A6 while at the same time the drive signal is applied through the amplifier 32 to the first group of fuel injection valves A1 to A3. In response to the high output of the detector circuit 34, the inverter 40 provides a low output which causes deenergization of the first three-way solenoid valve 26 to open the stop valve member 20*c* so as to allow fresh air to flow into the second group of cylinders #4 to #6 and also deenergization of the second three-way solenoid valve 28 to close the EGR valve member 24*c* so as to prevent recirculation of exhaust gases. Accordingly, the engine is placed in a full-cylinder mode of operation where all of the cylinders #1 to #6 are supplied with fuel and fresh air.

Under low load conditions, the detector circuit 34 provides a low output to cause the AND gate 36 to block the passage of the drive pulse signal from the fuel injection control circuit 30 so as to hold the second group of fuel injection valves A4 to A6 closed while the first group of fuel injection valves A1 to A3 are applied with the drive pulse signal and held operative. In response to the low output of the detector circuit 34, the inverter 40 provides a high output which causes energization of the first three-way solenoid valve 26 to close the stop valve member 20*c* so as to shut off the flow of fresh air to the second group of cylinders #4 to #6 and also energization of the second three-way solenoid valve 28 to open the EGR valve member 24*c* to as to allow exhaust gases to flow into the second branch 12*b*. Accordingly, the engine is placed in a split-cylinder mode of operation where the first group of cylinders #1 to #3 are supplied with fuel and fresh air while the second group of cylinders #4 to #6 are supplied with neither fuel nor fresh air.

If the engine load decreases from its high condition to a low condition, the first three-way solenoid valve 26 is energized to close the stop valve 20 a predetermined time after the second three-way solenoid valve 28 is energized to open the EGR valve 24 by the function of the delay circuit 44. Since the vacuum in the second branch 12*b* is substantially equal to that in the first branch 12*a* at this time, there is no possibility of the exhaust gases reintroduced into the second branch 12*b* from flowing into the first branch 12*a*.

If the engine load increases from its low condition to a high condition, the first three-way solenoid valve 26 is deenergized to open the stop valve 20 a predetermined time after the second three-way solenoid valve 28 is deenergized to close the EGR valve 24 by the function of the delay circuit 44. Since the exhaust gases filled in the second branch 12*b* are discharged by the pumping actions of the second group of cylinders #4 to #6 and the stop valve 20 opens after an increased vacuum appears in the second branch 12*b*, there is no possibility of exhaust gases from flowing into the first branch 12*a*.

The relationship between intake air flow rate and required drive signal pulse width is dependent upon whether the engine is in a full-cylinder or split-cylinder mode of operation and the pulse width in a split-cylinder mode should be substantially twice that in a full-cylinder mode. Such pulse width control may be effected after the engine is shifted in an essential split-cylinder mode of operation.

It is to be noted that a single fuel injection valve may be provided at the entrance of an intake manifold leading to each group of cylinders instead of a fuel injection valve provided at each intake manifold branch. Instead of the delay circuit 44, an orifice may be provided in a conduit connecting the first three-way solenoid valve th vacuum chamber of the stop valve.

Although the engine of this embodiment is designed to cause the stop valve 20 to open a predetermined time after the EGR valve member 24*c* closes when the engine load shifts from its low condition to a high condition and to cause the stop valve 20 to close a predetermined time after the EGR valve opens when the engine load shifts from its high condition to a low condition, it is to be understood that the stop valve 20 may close simultaneously with the opening of the EGR valve member 24*c* when the engine load shifts from its high condition to a low condition as long as the stop valve 20 opens a time after the EGR valve 24 closes when the engine load shifts from its low condition to a high condition.

Figure 5:
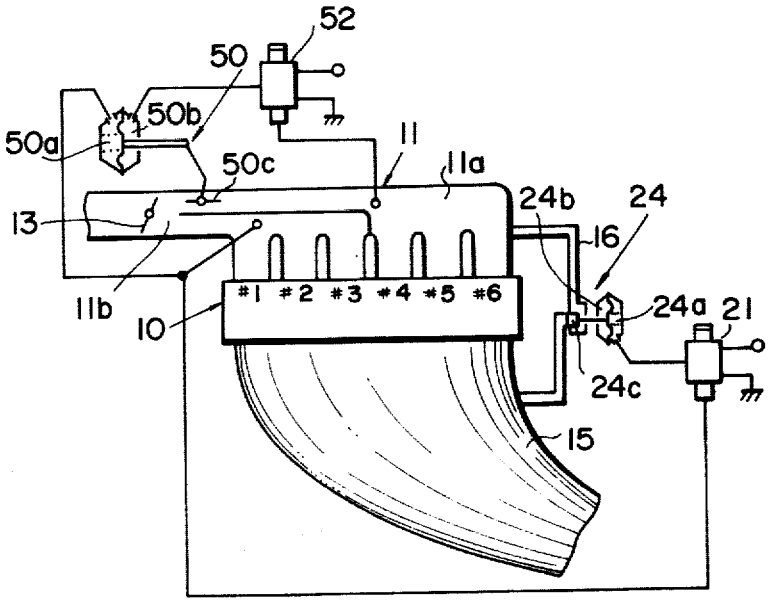
FIG. 5 is a schematic sectional view showing an alternative embodiment of the present invention.

Referring to FIG. 5, there is illustrated an alternative embodiment of the present invention which utilizes a number of the components previously described in connection with the first embodiment, and like reference numerals in FIG. 5 indicate like parts as described with reference to FIG. 2. The chief difference between FIG. 5 and the first described embodiment is that the delay circuit 44 and air block means including the stop valve assembly 20 and the first three-way solenoid valve 26 are removed and substituted with another air block means having a delay function. The air block means comprises a vacuum operated stop valve assembly 50 and a three-way solenoid valve 52. The stop valve assembly 50 includes a diaphragm spreaded within a casing to divide it into first and second vacuum chambers 50*a* and 50*b*, the first vacuum chamber 50*a* communicating with the first branch 12*a* of the intake passage 12, means drivingly connecting the diaphragm to a valve member 50*c* provided in the second branch 12*b*, and a balance spring provided within the first vacuum chamber 50*a* for urging the diaphragm toward the second vacuum chamber 50*b* to open the valve member 50*c*. The three-way solenoid valve communicates the second vacuum chamber 50*b* with the second branch 12*b* of the intake passage 12 when deenergized and with atmospheric air when energized.

In operation, when the engine is under high load conditions, the three-way solenoid valve is deenergized to cause the stop valve member 50*c* to open under the force of the balance spring and the three-way solenoid valve 28 is also deenergized to cause the EGR valve member 24*c* to close. The drive pulse is applied from the fuel injection control circuit 30 to all of the fuel injection valves for the respective cylinders #1 to #6. Accordingly, the engine is placed in a full-cylinder mode of operation.

When the engine load decreases from its high condition to a low condition, the three-way solenoid valve 52 is deenergized to cause the stop valve member 50*c* to close and at the same time the three-way solenoid valve 28 is energized to cause the EGR valve member 24*c* to open.

When the engine load increases from its low condition to a high condition, the three-way solenoid valve 28 is deenergized to communicate the vacuum chamber 24*a* with atmospheric air so as to close the EGR valve member 24*c* and at the same time the three-way solenoid valve 52 is deenergized to communicate the second vacuum chamber 50*b* with the second branch 12*b*. Thus, the stop valve member 50*c* is held closed when the EGR valve member 24*c* starts closing and it starts opening after the vacuum in the second passage 12*b* increases to a level substantially equal to that in the first branch 12*a*.

There has been provided, in accordance with the present invention, an improved split type internal combustion engine which is free from pumping loss during a split-cylinder mode of operation and rapid engine torque reduction when engine load shifts from its low condition to a high condition. While the present invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claim.

What is claimed is:

1. An internal combustion engine comprising:

(a) a plurality of cylinders split into first and second groups;

(b) an intake passage provided therein with a throttle valve, said intake passage divided downstream of said throttle valve into first and second branches leading to said first and second cylinder groups, respectively;

(c) a stop valve provided at or near an entrance of said intake passage second branch;

(d) an exhaust passage for said first and second cylinder groups;

(e) an EGR passage communicating between said exhaust passage and said intake passage second branch;

(f) an EGR valve provided in said EGR passage; and (g) control means, responsive to engine load conditions, for disabling said second cylinder group, closing said stop valve, and opening said EGR valve during the occurrence of high engine load conditions, said control means effective for closing said EGR valve and opening said stop valve with a delay relative to the closing of said EGR valve when the engine load changes from the low load conditions to a high load condition.

2. An internal combustion engine according to claim 1, wherein said control means comprises:

a pulse generator means for generating a pulse signal corresponding to engine load;

a load detector means, responsive to said pulse signal, for detecting the engine load and producing a control signal having first and second levels, said first level representing high load conditions, and said second level representing low load conditions;

first actuator means, responsive to said first level of the control signal from said load detector, for opening said stop valve and, responsive to said second level of the control signal from said load detector, for closing said stop valve;

second actuator means, responsive to said first level of the control signal from said load detector, for closing said EGR valve and, responsive to said second level of the control signal, for opening said EGR valve; and delay means, interposed between said load detector and said said first actuator means, for delaying change of said control signal from said second level to said first level applied to said first actuator.

3. An internal combustion engine according to claim 2, wherein said first actuator means comprises:

a servo mechanism, responsive to atmospheric pressure, for opening said stop valve and, responsive to vacuum, for closing said stop valve; and a solenoid valve, responsive to the first level of the control signal from said load detector, for providing communication between said servo mechanism and the atmosphere and, responsive to the second level of the control signal from said load detector, for providing communication between said servo mechanism and said intake passage first branch.

4. An internal combustion engine according to claim 3, wherein said servo mechanism comprises:

a casing;

a diaphragm disposed in said casing to define first and second chambers therein, said first chamber communicating with said solenoid valve, said second chamber opening into the atmosphere; and means, drivingly connecting said diaphragm to said stop valve, for opening said stop valve when said first chamber communicates with the atmosphere and for closing said stop valve when said first chamber communicates with said intake passage first branch.

5. An internal combustion engine according to claim 1, wherein said control means comprises:

a pulse generator means for generating a pulse signal corresponding to engine load;

a load detector means, responsive to said pulse signal, for detecting the engine load and producing a control signal having first and second levels, said first level representing high load conditions, and said second level representing low load conditions;

first actuator means, responsive to said first level control signal from said load detector, for closing said EGR valve and, responsive to the second level control signal from said load detector, for opening said EGR valve; and second actuator means comprising:

a casing;

a diaphragm disposed in said casing to define first and second chambers therewith, said first chamber communicating with said intake passage first branch; means for drivingly connecting said diaphragm to said stop valve; and a solenoid valve, responsive to the first level of the control signal from said load detector, for providing communication between said second chamber and said intake passage second branch and for causing said stop valve to open after any pressure difference between said intake passage first and second branches decreases substantially to zero, said solenoid valve, responsive to said second level of the control signal from said load detector, for providing communication between said second chamber and the atmosphere and for causing said stop valve to close.

* * * * *